US005909937A

United States Patent [19]

Jenkins et al.

[11] Patent Number: 5,909,937

[45] Date of Patent: Jun. 8, 1999

[54] REFRIGERATOR DOOR ASSEMBLY

[75] Inventors: Thomas Edward Jenkins; Duane Jubenville, both of Louisville, Ky.

[73] Assignee: General Electric Company, Louisville, Ky.

[21] Appl. No.: 08/783,779

[22] Filed: Jan. 15, 1997

Related U.S. Application Data

[63] Continuation of application No. 08/410,903, Mar. 27, 1995.

[51] Int. Cl.[6] ..... A47B 96/04

[52] U.S. Cl. ..... 312/405.1; 312/406; 312/400; 49/501

[58] Field of Search ..... 312/213, 405, 312/405.1, 406, 408, 116, 321.5, 400, 401; 220/467; 49/501, 478.1

[56] References Cited

U.S. PATENT DOCUMENTS

| | | | |
|---|---|---|---|
| 2,612,661 | 10/1952 | Semple . | |
| 2,708,294 | 5/1955 | Saunders . | |
| 2,725,271 | 11/1955 | Cunningham | 312/405 |
| 2,728,958 | 1/1956 | King | 312/405 |
| 2,764,785 | 10/1956 | Sulcek . | |
| 2,852,328 | 9/1958 | Jewell et al. | 312/405.1 |
| 3,000,058 | 9/1961 | Thielen, Jr. . | |
| 3,078,003 | 2/1963 | Kesling . | |
| 3,403,477 | 10/1968 | Light . | |
| 3,813,137 | 5/1974 | Fellwock et al. | 220/467 X |
| 3,882,637 | 5/1975 | Lindenschmidt | 49/478.1 X |
| 4,107,833 | 8/1978 | Knight et al. | 312/406 X |
| 4,190,305 | 2/1980 | Knight et al. . | |
| 4,536,990 | 8/1985 | Siegrist et al. | 49/501 |
| 4,583,796 | 4/1986 | Nakajima et al. | 49/478.1 X |
| 4,589,240 | 5/1986 | Kendall et al. | 49/501 X |
| 4,740,042 | 4/1988 | Stich et al. . | |
| 4,747,245 | 5/1988 | Lesmeister et al. . | |
| 4,779,939 | 10/1988 | Stich . | |
| 4,787,133 | 11/1988 | Lesmeister et al. | 49/501 |
| 5,520,453 | 5/1996 | Aoki et al. | 312/406 |
| 5,588,731 | 12/1996 | Schmidt et al. | 312/405 |
| 5,599,081 | 2/1997 | Reulett et al. | 312/405.1 X |

FOREIGN PATENT DOCUMENTS

| | | | |
|---|---|---|---|
| 59-9032 | 1/1984 | Japan . | |
| 1200184 | 8/1989 | Japan . | |
| 2040482 | 2/1990 | Japan | 312/400 |
| 2133787 | 5/1990 | Japan | 312/400 |
| 729392 | 5/1955 | United Kingdom | 312/405 |

*Primary Examiner*—Peter M. Cuomo
*Assistant Examiner*—James O. Hansen
*Attorney, Agent, or Firm*—H. Neil Houser

[57] ABSTRACT

A refrigerator door has an outer member formed from a folded sheet of steel, with a front panel and a perpendicularly projecting flange forming a cavity. A reinforcing member of thin sheet steel has a front panel, smaller than the outer member front panel, with a perpendicularly projecting flange. The reinforcing member is positioned in the cavity. A body of insulation foamed-in-place in the cavity secures the reinforcing member within the cavity in spaced apart relationship with the outer member.

9 Claims, 2 Drawing Sheets

14
11
12
26
40
30
28
13
10
19
24
15
42
20
18
15
34
3
3
18
16
40

46
28
44
46
48
48
38
24
34
32
36

36
46
44
28
30
24
34
48
48
32

REFRIGERATOR DOOR ASSEMBLY

This application is a continuation of copending application Ser. No. 08/410,903 filed on Mar. 27, 1995.

BACKGROUND OF THE INVENTION

In order to conserve on the expensive steel used to manufacture domestic refrigerators, the practice for several years has been to make the cabinet and doors of such refrigerators from rather thin sheet steel, often on the order of 0.017 inch thick. One result is that the doors often must be reinforced in order to maintain their rectangular shape and support the items stored in door mounted shelves. The normally used foamed-in-place urethane insulation provides some stiffening and reinforcing. However, on some models, particularly with larger doors, additional reinforcing is needed. One approach has been to attach cross braces to the inside of the door before the insulation is injected. Such braces are relatively expensive, canceling a part of the savings of using thin material for the door. Another approach has been to use a sheet of cardboard which adheres to the insulation. One problem with that approach is the propensity of the cardboard to shift in the door cavity before the foam cures. Yet another approach has been to use a large sheet of paper or aluminum foil which is placed in the door cavity before the insulation material is injected. The sheet is sufficiently large to assure that it covers the inside of the door, even if the sheet shifts. However, this requires that an operator remove the excess paper or foil after the foaming operation. Also such materials do not provide optimum reinforcement. In summary, none of the prior approaches has been fully satisfactory.

Therefore, it is an object of this invention to provide an improved reinforced door assembly for use in refrigerators.

It is another object of this invention to provide such an improved door assembly, including a high modulus of elasticity reinforcing member with a front panel and a generally perpendicularly projecting flange which is secured in a predetermined position within the door cavity.

SUMMARY OF THE INVENTION

According to one embodiment of the present invention a refrigerator door assembly has an outer member with a front panel and a perpendicular peripheral flange forming a cavity. A reinforcing member of a high modulus of elasticity, with a front panel and a perpendicular peripheral flange, is received in the cavity. A body of foamed-in-place insulation secures the reinforcing member in a predetermined position within the cavity.

DETAILED DESCRIPTION OF PREFERRED EMBODIMENT

Figure 1:
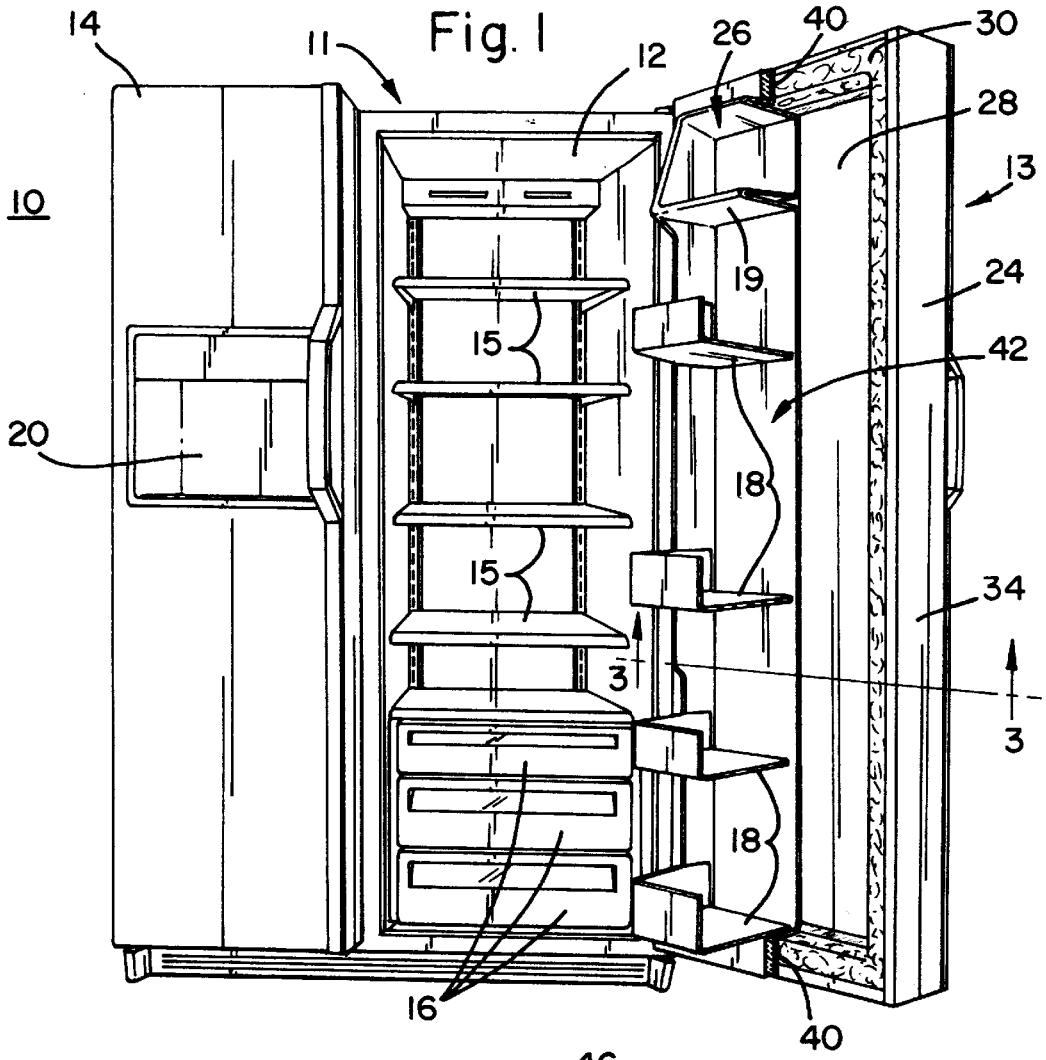
FIG. 1, is a front view of a side-by-side refrigerator with the fresh food access door open and with a portion of the inner door member broken away for purposes of illustration.

Referring particularly to FIG. 1, there is illustrated a household refrigerator 10 of the side-by-side type; that is the cabinet 11 includes a fresh food storage compartment 12 and a freezer storage compartment arranged in a side-by-side configuration. Each of the storage compartments has a front access opening which is normally closed by fresh food door 13 and freezer door 14, respectively. The particular refrigerator configuration illustrated in FIG. 1 is shown for illustrative purposes only and it will be understood that the present invention also is applicable to other types of refrigerators such as, for example, top mount refrigerators in which the freezer is positioned above the fresh food compartment. Various operating components of refrigerators, such as the refrigeration system for example, are not involved with the present invention and have been omitted for the sake of simplicity.

Typically the fresh food compartment 12 is provided with several support structures on which various items are placed for storage. For example the illustrative compartment has adjustable shelves 15 and lower drawers 16. In addition the inner member 26 of the fresh food door assembly 13 supports shelves 18 and has a butter or cheese compartment 19. The freezer compartment typically includes shelves and baskets to store items and the inner member of the freezer door assembly supports shelves to store additional items. Also, more fully featured refrigerators include automatic ice makers and the freezer door includes a through-the-door dispensing mechanism 20.

Figure 2:
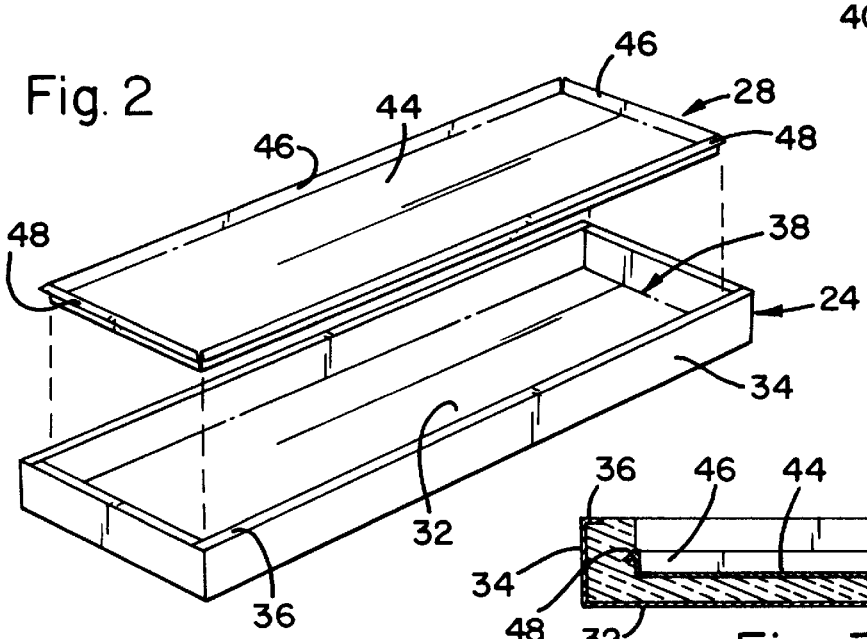
FIG. 2 is a somewhat schematic perspective view of the fresh food access door of FIG. 1, with the reinforcing member removed from the outer member and with the inner member omitted for purposes of illustration.
Figure 3:
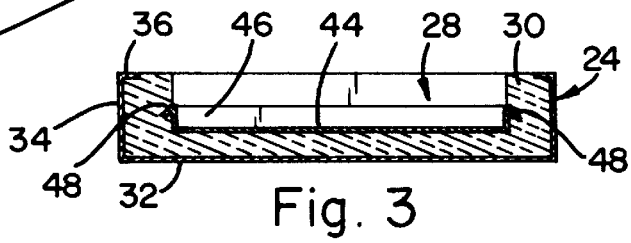
FIG. 3 is a cross-section view of the fresh food access door of FIG. 1 generally as seen along line 3—3 in FIG. 1 and with the inner member omitted for purposes of illustration.

Viewing FIGS. 1–3, the fresh food door assembly 13 includes an outer member 24, an inner member 26, a reinforcing member 28 and a body of foamed-in-place insulation 30. The outer member 24 has a planar front panel 32 surrounded by a peripheral flange 34 that extends along the top, sides and bottom edges of panel 32 and projects generally perpendicular to panel 32. The distal edge of the flange 34 is formed with a rim 36 that extends along the top, sides and bottom of the flange 34 and projects generally perpendicular to flange 34 to overlie the outer portion of the panel 32. The outer door member defines a cavity 38. Typically the outer member 24 is formed by bending or folding a sheet of a suitable metal, normally steel. The inner member 26 includes a flange portion 40 which extends completely around the periphery of the member 26. The flange overlies and is mounted to the outer member rim 36 to support the inner member from the outer member. Within flange 40, inner member 26 includes a central portion 42 which is recessed to fit within the cavity 38 and which provides the support for shelves 18 and butter and cheese keeper 19. The space within cavity 38 between outer member 24 and inner member 36 is substantially filled with a body 30 of foamed-in-place insulation. Typically the inner member 26 is molded from a suitable plastic material and the insulation is a polyurethane foam.

A significant cost savings can be obtained by making the outer door member 24 as thin as possible. However, the door must maintain a planar shape and support all the items placed on shelves 18 without twisting. While the foam insulation 30 and the inner member 26 provide some additional structural strength and rigidity, many doors, particularly the large doors in side-by-side refrigerators need additional reinforcement.

In accordance with one aspect of the present invention there is provided a reinforcing member 28 formed of a high modulus of elasticity material, preferably having a modulus of elasticity of at least about fifteen million psi. Referring generally to FIGS. 2 and 3, the reinforcing member 28 includes a front panel 44 surrounded by a peripheral flange 46 that extends along the top, sides and bottom edges of panel 44 and projects generally perpendicular to panel 44. The distal edge of the flange 46 is formed with a rim 48 that extends along the top, sides and bottom of the flange 46. The rim projects outward of the flange 46 and is return bent. The reinforcing member front panel 44 is slightly smaller than the opening provided by the inner edge of front member rim 36 and the reinforcing member peripheral flange 46 is narrower than the peripheral flange 34 of the outer member 24. In this way the reinforcing member 28 is received within the cavity 38 with sufficient spacing from the outer member for the body 30 of foamed-in-place insulation to completely separate the reinforcing member from the outer door member. As seen in FIG. 3 the insulation 30 is in intimate contact with both outer member 24 and reinforcing member 28 and bonds them together. The reinforcing member rim 48 is embedded in the foam 30, which adds to the bond between the reinforcing member and the foam. The reinforcing member provides significant added structural strength and rigidity to the door assembly 13.

The normal way to manufacture doors similar to 13, but without the reinforcing member 28, is to pre-form the outer member 24 and mold the inner member 26. The outer member then is placed in a mold and the mold cover is closed. The cover includes a plug which extends into the outer member and defines the inner surface of the cavity 38 to receive the central portion of inner member 26. Then the constituents of the foam 30, in liquid form, are injected into the space between the outer member and the plug. The constituents react and form the foam. Once the foam is cured, the cover and plug are removed and the outer member 24 and foam 30 sub-assembly is removed from the mold. Then the inner member 26 then is attached to the outer member 24.

In manufacturing the door 13, the reinforcing member is preformed so that its front face 44 fits against the end of the plug and its peripheral flange 46 fits closely around the periphery of the plug. The reinforcing member is placed on the end of the plug before the mold cover is closed. When the plug is inserted into the mold, the reinforcing member 28 remains on the end of the plug and does not shift in the mold so that its spatial relationship to the outer member remains as intended. Once the insulation 30 cures, the cover and plug are removed. The insulation adheres to the reinforcing member and the reinforcing member separates from the plug. Thereafter the inner member is mounted on the outer member.

The door assembly 13 is of a type commonly called a "deep door". That is the outer door member peripheral flange 34 is between about 3.0 inches and about 3.5 inches wide, and may be as wide as about 4.0 inches wide. This provides space to receive an inner door central section designed to support shelves for relative large items. In addition, many side-by-side refrigerators are rather large, currently up to about twenty-five cubic feet of storage space. Thus their doors have rather large cross section areas. Considering performance and cost we prefer to use either a sheet of cold rolled steel or a sheet of aluminum to form the reinforcing members for such doors. If steel, we prefer that the sheet have a thickness between about 0.007 inch and about 0.010 inch. If aluminum, we prefer that the sheet have a thickness of between about 0.012 inch and about 0.015 inch. In either event we prefer that the reinforcing member peripheral flange be at least about 0.25 inch wide to assure that the reinforcing member remains on the mold plug during the foaming operation. A peripheral flange width of up to about 1.0 inch will provide a very good bond between the reinforcing member and the insulation and still provide for a sufficient thickness of insulation between the outer member front panel 32 and the reinforcing member front panel 44.

Some more fully featured refrigerators have beverage storage mechanisms mounted in the fresh food door, which extend through the door to be accessible without opening the door. In such doors separate reinforcing members can be provided above and below the beverage storage mechanism.

Freezer door assembly 14 is similar to fresh food door assembly 13. However, the assembly has a somewhat smaller cross section area and the ice dispensing mechanism 20 extends completely through the door 14. Normally two separate reinforcing members are used, with one received in the area above and one in the area below the dispensing mechanism. In less fully featured refrigerators, there will be no dispensing mechanism 20 and the freezer door will be very similar to the fresh food door, except of a slightly smaller cross section size.

Figure 4:
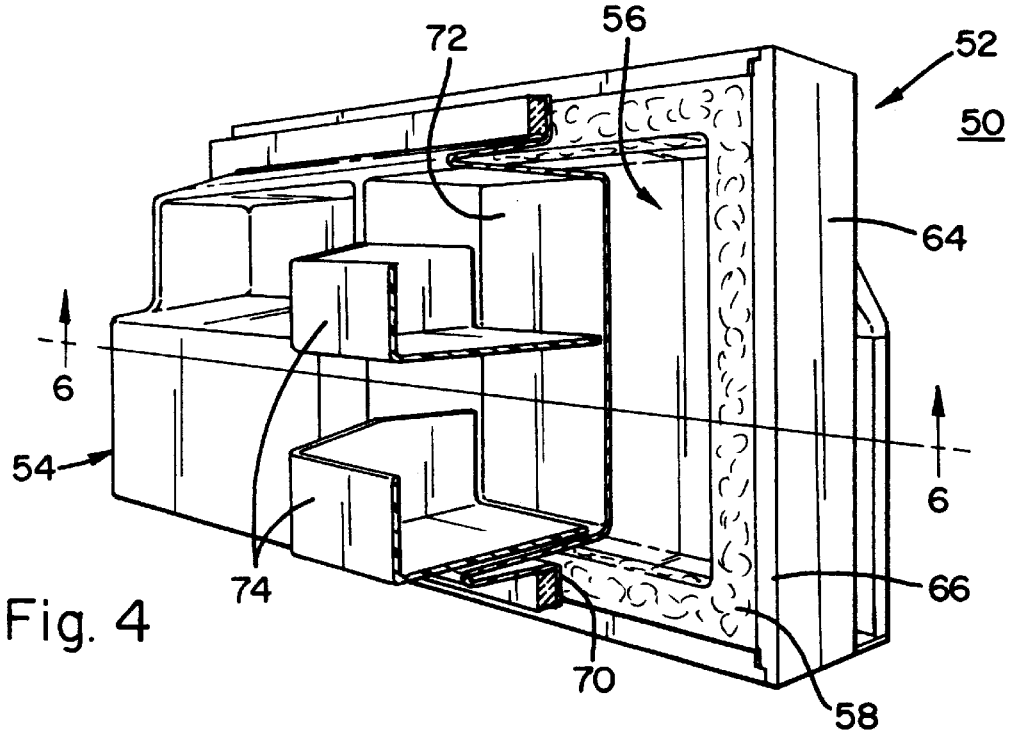
FIG. 4 is a perspective view of the freezer access door of a top mount refrigerator with a portion of the inner member broken away for purposes of illustration.
Figure 5:
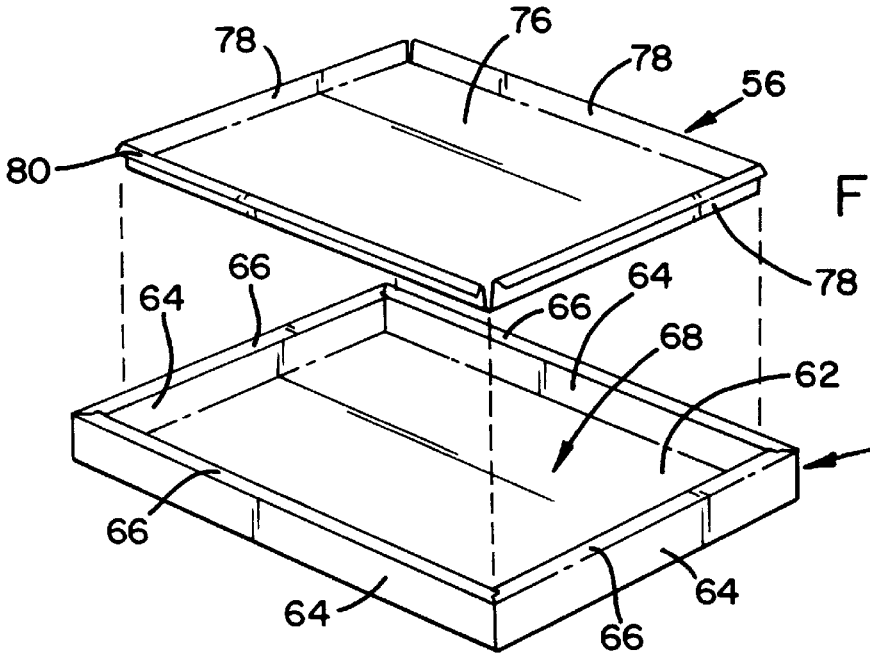
FIG. 5 is a somewhat schematic perspective view of the door of FIG. 4 with the reinforcing member removed from the outer member and with the inner member omitted for purposes of illustration.
Figure 6:
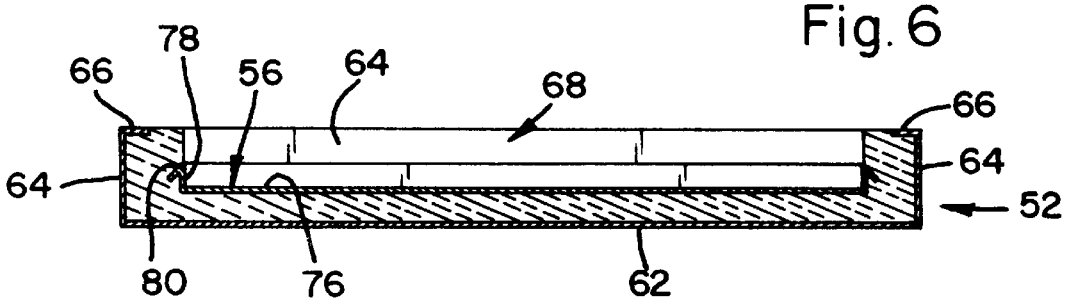
FIG. 6 is a cross-section view of the door of FIG. 4 generally as seen along line 6—6 in FIG. 4 and with the inner member omitted for purposes of illustration.

FIGS. 4–6 illustrate a freezer door assembly 50 for a top mount refrigerator. The door assembly 50 includes an outer member 52, an inner member 54, a reinforcing member 56 and a body of foamed-in-place insulation 58. The outer member 52 has a front panel 62 surrounded by a peripheral flange 64 that extends along the top, sides and bottom edges of panel 62 and projects generally perpendicular to panel 62. The distal edge of the flange 64 is formed with a rim 66 that extends along the top, sides and bottom of the flange 64 and projects generally perpendicular to flange 64 to overlie the outer edge portion of the panel 62. The outer door member defines a cavity 68. Typically the outer member 52 is formed by bending or folding a sheet of a suitable metal, normally steel.

The inner member 54 includes a flange portion 70 which extends completely around the periphery of the member 54. The flange overlies and is mounted to the rim 66 to support the inner member from the outer member. Within flange 70, inner member 54 includes a central portion 72 which is recessed to fit within the cavity 68 and which provides the support for items such shelves 74. The inner member 54 normally is molded from a suitable plastic material. The space within cavity 68 between outer member 52 and inner member 54 is substantially filled with a body 58 of foamed-in-place insulation. Typically the inner member is molded from a suitable plastic material and the insulation is a polyurethane foam.

The reinforcing member 56 is formed of a high modulus of elasticity material, preferably having a modulus of elasticity of at least about fifteen million. The reinforcing member 56 includes a front panel 76 surrounded by a peripheral flange 78 that extends along the top, sides and bottom edges of panel 76 and projects generally perpendicular to panel 76. The distal edge of the flange 78 is formed with a rim 80 that extends along the top, sides and bottom of the flange 78. The rim projects outward of the flange 78 and is return bent. The reinforcing member front panel 76 is slightly smaller than the opening provided by the inner edge of front member rim 66 and the reinforcing member peripheral flange 78 is narrower than the peripheral flange 64 of the outer member 52. In that way the reinforcing member 56 is received within the cavity 68 with sufficient spacing from the outer member for the body 58 of foamed in place insulation to completely separate the reinforcing member from the outer door member. As seen in FIG. 5 the insulation 58 is in intimate contact with both outer member 52 and reinforcing member 56 and bonds them together. The reinforcing member rim 80 is embedded in the foam 58 which aids the bond between the reinforcing member and the foam. The reinforcing member provides significant added structural strength and rigidity to the door assembly 50.

It will be understood that more highly featured top mount refrigerators include automatic ice makers with through-the-door ice and water dispensing. In such machines the freezer door assembly may include a separate reinforcing member on each side of the dispenser. Many such highly featured refrigerators also may have a beverage storage mechanisms mounted in the fresh food door assembly and extending through the door for access without opening the door. In such doors there may be a separate reinforcing member on each side, either laterally of vertically as the case may be, of the beverage storage mechanism. In less highly featured refrigerators, without some mechanism penetrating completely through the door assembly, it is presently preferred to utilize a single reinforcing member which substantially fills the cross section of the opening formed by the outer door member rim.

With present day foamed-in-place insulation it is desirable that the insulation adjacent the outer door member front panel be at least about 1.5 inches thick on fresh food doors and at least about 1.75 inches thick on freezer doors.

Since the outer door member peripheral flange on "deep doors" is between about 3.0 and 4.0 inches, the inner door member can be recessed into the cavity in the outer door member between about 1.25 and about 2.5 inches to support wide shelves for holding large items. This space also provides significant freedom of design as to the width of the reinforcing member flange. While a reinforcing member flange width of at least about 0.10 inch and preferably about 0.25 inch will assure that the reinforcing member remains in place on the end of the mold plug during the foaming process, we have found that a width of about 1.0 inch will enhance the stiffening effect of the reinforcing member. Of course, it will be understood that, after balancing such factors as ease and sureness of manufacture, the degree of reinforcement desired and the cost of the reinforcing member material, a manufacturer may choose to use different width reinforcing member flanges on various models of its refrigerators. A reinforcing member flange width of up to about 2.0 inches will provide sufficient space for a "deep door" inner member designed to store many large items.

Many smaller refrigerators, particularly many smaller sized top mount refrigerators, have "thin doors" rather than "deep doors". In such doors the outer door member peripheral flanges are between about 1.25 and 2.0 inches wide. Thus the insulation often essentially completely fills the cavity in the outer door member and the inner door member projects into the cavity very little, if at all. Such doors often have a smaller cross-section size than deep doors. Also fewer or smaller items can be stored in a thin door than in a deep door of the same cross-section size. Thus, the reinforcement needed for such thin doors normally is less than for corresponding deep doors. In some models it is possible to use a reinforcing member with a narrow peripheral flange, for example a a reinforcing member with a flange between about 0.10 and about 1.0 inch. In some very thin doors it may not be possible to provide the reinforcing member with a flange that fits around the mold plug. In that event either a thicker, planar reinforcing member or a reinforcing member with a narrow flange that projects toward the outer door member front panel, for example, would enhance the reinforcement. However, some other way would be needed to assure that the reinforcing member stays in place on the end of the mold plug during the foaming process. By way of example, weak magnets could be imbedded in the mold plug or some "sticky" coating could be applied to the face of the plug to hold the reinforcing member in place during the foaming operation.

The various alternative forms of domestic refrigerator door configuration have not been illustrated for the sake of simplicity as they are well known and those skilled in the art will appreciate how to apply the present invention to each of them.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator door assembly, comprising:

an outer member having a front panel with a peripheral flange projecting generally perpendicular thereto and forming a cavity;

an inner member mounted to said outer member;

a reinforcing member of high modular elasticity material having a front panel, smaller than said outer member front panel, with a peripheral flange, narrower than said outer member peripheral flange, projecting perpendicular thereto, said reinforcing member located substantially entirely within said cavity and between said outer member and said inner member, said front panel spaced from said outer member front panel; and a body of insulation foamed-in-place in said cavity, said insulation securing said reinforcing member in a predetermined position within said cavity in spaced apart relationship with said outer member, said insulation body substantially entirely filling the space between said outer member front panel and said reinforcing member front panel so that said insulation body bonds said reinforcing member to said outer member and said reinforcing member provides support for said outer member.

2. A door assembly as set forth in claim 1, wherein: said reinforcing member has a modulus of elasticity of at least about fifteen million psi.

3. A refrigerator door assembly as set forth in claim 1, wherein: said reinforcing member is formed of sheet steel between about 0.007 inch and about 0.010 inch thick.

4. A refrigerator door assembly as set forth in claim 1, wherein: said reinforcing member is formed of sheet aluminum between about 0.012 inch and about 0.015 inch thick.

5. A refrigerator door assembly as set forth in claim 1, wherein:

said outer member peripheral flange is between about 3.0 inches and about 4.0 inches wide; said reinforcing member peripheral flange is between about 0.10 inch and about 2.0 inches wide; and said insulation between said front panels of said outer and reinforcing members is between about 1.5 inches and about 1.75 inches thick.

6. A refrigerator door assembly as set forth in claim 1, wherein:

said outer member peripheral flange is between about 3.0 inches and about 4.0 inches wide; said reinforcing member peripheral flange is between about 0.25 inch and about 1.0 inch wide; and said insulation between said front panels of said outer and reinforcing members is between about 1.5 inches and about 1.75 inches thick.

7. A refrigerator door assembly as set forth in claim 1, wherein:

said outer member peripheral flange is between about 1.25 inches and about 2.0 inches wide; said reinforcing member peripheral flange is between about 0.10 inch and about 1.0 inch wide.

8. A refrigerator door assembly as set forth in claim 1, wherein: a rim extends outward along a distal edge of said reinforcing member peripheral flange and is embedded in said insulation.

9. A refrigerator door assembly as set forth in claim 1, wherein:

a rim projects inward along said peripheral flange of said outer member; and further including an inner member having a flange mounted to said rim of said outer member.

* * * * *